US007899203B2

(12) United States Patent
Van Halteren et al.

(10) Patent No.: US 7,899,203 B2
(45) Date of Patent: Mar. 1, 2011

(54) TRANSDUCERS WITH IMPROVED VISCOUS DAMPING

(75) Inventors: Aart Zeger Van Halteren, Hobrede (NL); Paul Christiaan Van Hal, Amsterdam (NL); Onno Geschiere, Amsterdam (NL)

(73) Assignee: Sonion Nederland B.V., Amsterdam (NL)

( * ) Notice: Subject to any disclaimer, the term of this patent is extended or adjusted under 35 U.S.C. 154(b) by 1202 days.

(21) Appl. No.: 11/521,789

(22) Filed: Sep. 15, 2006

(65) Prior Publication Data

US 2007/0058833 A1 Mar. 15, 2007

Related U.S. Application Data

(60) Provisional application No. 60/717,377, filed on Sep. 15, 2005.

(51) Int. Cl.
*H04R 25/00* (2006.01)

(52) U.S. Cl. ..... 381/418; 381/396; 381/417

(58) Field of Classification Search ..... 381/186, 381/396, 412, 417–418, 423–424
See application file for complete search history.

(56) References Cited

U.S. PATENT DOCUMENTS

| | | | | |
|---|---|---|---|---|
| 6,041,131 | A | 3/2000 | Kirchoefer et al. | 381/415 |
| 7,362,878 | B2 * | 4/2008 | Miller et al. | 381/418 |
| 7,415,125 | B2 * | 8/2008 | Warren et al. | 381/418 |

* cited by examiner

*Primary Examiner* — Suhan Ni
(74) *Attorney, Agent, or Firm* — Nixon Peabody LLP

(57) ABSTRACT

A miniature receiver or transducer with improved viscous damping. The receiver may be a moving armature receiver using shearing forces for damping the deflection of the diaphragm. In this receiver, the damping element, which may be a liquid, extend in a direction of the deflection of the armature or diaphragm. Another embodiment relates to a transducer where the damping element engages the diaphragm.

10 Claims, 3 Drawing Sheets

TRANSDUCERS WITH IMPROVED VISCOUS DAMPING

CROSS REFERENCE TO RELATED APPLICATIONS

This application claims the benefit of priority of U.S. Provisional Patent Application No. 60/717,377, filed Sep. 15, 2005, which is hereby incorporated by reference in its entirety.

FIELD OF THE INVENTION

The present invention relates to transducers using viscous damping. An interesting aspect of the invention relates to a moving armature receiver which comprises a damping mechanism based on fluid shearing forces between respective surface portions of a first damping member and a second damping member.

BACKGROUND OF THE INVENTION

U.S. Pat. No. 6,041,131 discloses a miniature moving armature receiver that comprises a damping fluid arranged inside a magnetic gap or a coil tunnel of the receiver. The damping fluid provides improved shock protection of the receiver and/or acoustical damping of a frequency response of the receiver by damping armature movement within the magnetic gap or the coil tunnel of the receiver.

The ability to omit traditional acoustical screens or grids in a sound outlet port of the receiver to provide damping or control of the receiver frequency response is one advantage of a damping fluid. Common hearing aid design practices tend to leave the receiver's sound outlet port positioned deeply inside the hearing-aid user's ear canal where the acoustical screen is vulnerable to clogging by cerumen and/or sweat from the user's ear canal during use. Consequently, the hearing aid's sound passage becomes blocked during use and leaves the hearing aid in a partly or fully inoperative state.

A further disadvantage of acoustical screens in a hearing aid context is the imposed size requirements. The very small dimensions required for the acoustical screens render the acoustical screens difficult to manufacture with sufficient precision to provide consistent and predictable acoustical properties.

The above-mentioned prior art arrangement of damping fluid inside the magnetic gap or the coil tunnel of the receiver is associated with certain disadvantages. For example, it is difficult to introduce a correct amount of damping fluid into the magnet or coil gap to obtain the desired acoustical damping. This difficulty is caused partly by the very small dimensions of the coil gap or magnetic gap in a miniature receiver and partly by the inaccessible location of the coil gap or magnetic gap. Introducing too high or too low an amount of damping fluid will lead to a frequency response which deviates from the desired or target response. It is also difficult to ensure an even distribution of the utilized damping fluid above and below the armature so as to prevent introduction of harmonic distortion caused by asymmetrical fluid forces.

BRIEF DESCRIPTION OF THE DRAWINGS

Preferred embodiments of the invention in the form of miniature hearing aid receivers and miniature loudspeakers will be described in the following with reference to the accompanying drawings, wherein.

Figure 1:
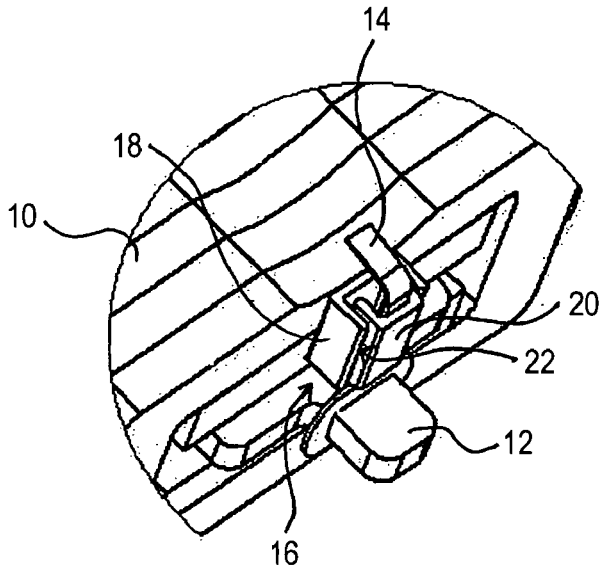
FIG. 1 is a schematic illustration of selected elements of a moving armature receiver according to a first embodiment of the invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF PREFERRED EMBODIMENTS

In a first aspect, the invention relates to a moving armature receiver comprising a drive coil, a permanent magnet assembly, an armature, a diaphragm, a first surface part, a second surface part, and a deformable damping element. The permanent magnet assembly is adapted to generate a magnetic flux. The armature comprises a deflectable armature portion being deflectable in a predetermined direction in relation to the coil and the magnet. The diaphragm is operatively attached to the deflectable armature portion. The first and the second surface parts each extend at least substantially in the predetermined direction. The first surface part forms part of, or is operatively attached to, the deflectable armature portion and/or the diaphragm. The second surface part is translatable in the predetermined direction in relation to the first surface part. The deformable damping element engages both surface parts.

Consequently, an improved frequency response damping technique of moving armature receivers is obtained.

According to the present invention acoustical damping is provided by a deformable damping element which may be one or more of: a gel, a cured gel, a liquid, a fluid, a paste, and/or a foam, an emulsion, or a suspension comprising one of those. In the situation, where the damping element is a fluid, it may to a large extent be independent of the amount of applied damping fluid. Acoustical damping in accordance with the present invention relies, especially when using Newtonian fluids, only on fluid shearing forces which inherently act in a symmetrical and linear manner.

In addition, the position of the first and second surface parts, and thereby of the dampening element, is now no longer required to be within the magnet gap or the coil tunnel as in the prior art.

Also, naturally, the first surface part may be related to the armature portion in any suitable manner, such as actually forming part of the armature portion or being a part of an element attached to the armature portion, such that the movement of the first surface part may be related to that of the armature portion. In that manner, the damping of the first surface part will be converted into a damping of the armature portion.

In the present context, the diaphragm is operatively attached to the armature portion, when forces or movement is transferred there-between. Normally, the diaphragm and armature are interconnected by a substantially stiff element, such as a metallic drive pin or rod. However, the diaphragm and armature (portion) may be provided as a single, monolithic element. Alternatively, a motion reversing coupling mechanism may be interdisposed between the deflectable armature portion and the diaphragm. In that situation, the first surface part is again positioned or selected in a manner so that damping of the motion thereof provides a damping of the diaphragm.

Normally, the two surface parts will be opposite and facing each other so that the deformable material may be positioned between the two surface parts. This has the disadvantage that the positioning and possibly the dosing of the deformable element (e.g., when it is a liquid) may be facilitated.

Often, the predetermined direction is at least substantially perpendicular to a plane of the diaphragm. This will be the simplest manner of deflecting the diaphragm.

It should be noted that if the movement of the armature part is a rotation or a non-linear movement, or if the actual deflection of the armature part cannot be sufficiently approximated by a linear movement, it may be desired to provide the first and second surface parts as curved parts so that these may be moved in relation to each other, in accordance with the deflection, while maintaining a distance there-between at least substantially constant during the deflection of the armature part. Otherwise, if the movement is (at least approximately) within a given plane, it may be desired to provide the surface parts as plane surfaces parallel with that plane.

In one embodiment the drive coil forms a coil tunnel, the permanent magnet assembly is adapted to generate the magnetic flux in a magnetic gap and the armature extends through the coil tunnel and the magnetic gap. This may be a normal moving armature set-up where the armature may be a bent or U-shaped part, part of which is fixed in relation to the magnet/coil and a part of which is that extending through the coil/magnet.

Preferably, the deformable damping element is adapted to be deformed by the translation, in the predetermined direction, of the second surface part in relation to the first surface part. In this manner, the deformation will dampen the deflection and the translation.

According to one embodiment, a major/substantial part of an outer surface of the material engages the first and second surface parts. In this manner, it may be ensured that the overall damping effect is due to the shearing effect.

In one embodiment, the second surface part is at least substantially stationary in relation to the magnet and/or the coil. In that manner, the damping is in relation to the actual deflection of the armature part or diaphragm.

According to another embodiment, the receiver comprises a first element comprising the first surface part and a second element comprising the second surface part, the first element being a part of or being operatively connected to the deflectable armature part or the diaphragm, the first and second elements being U-shaped comprising a base part and two leg parts, the leg parts of one of the first and the second elements extending between the leg parts of the other of the first and second elements, the deformable damping element being positioned between a leg part of the first and the second element.

In fact, a deformable damping element may be positioned between the leg parts of both pairs of a leg part of the first element and a leg part of the second element. In this manner, a self centering may be obtained, which facilitates both design and production of the dampening element.

In yet another embodiment, the first surface part is defined by a hole or opening in the diaphragm, and wherein the second surface part is defined by an element extending though the hole/opening in the diaphragm.

In this manner, the first surface part may be defined by the surface part in a hole/opening of the diaphragm. In this manner, the surface part may still be directed in the direction of deflection of the diaphragm.

The area of this surface part will depend both on the thickness of the diaphragm as well as the size and shape (in the plane of the diaphragm) of the hole or opening.

Naturally, the element extending through the hole/opening can also have a surface part extending in the same direction and have an outer contour, also in the plane of the diaphragm, corresponding to that of the hole/opening.

This element extending through the hole/opening may be attached to other elements of the receiver, such as the coil, the magnet, and/or a housing encasing the receiver or at least the diaphragm.

In any case, the present structure of the surface parts and the damping element separates the deflection of the armature part and the deformation of the deformable element so that the deflectable armature part may be adapted to be deflected, in the predetermined direction, at least a predetermined minimum deflection, and wherein a distance between the first and second surface parts is between 10% and 1000% of the minimum deflection.

In addition, it is preferred that the distance between the first and second surface parts varies no more than 40% during the deflection of the armature part. In some embodiments, the distance between the first and second surface parts varies by no more than 20%. In other embodiments, the distance between the first and second surface parts varies by typically no more than 10% during the deflection of the armature part. In yet other embodiments, the distance between the first and second surface parts varies by no more than 5%. While in still other embodiments, the distance between the first and second surface parts varies by no more than 2% during the deflection of the armature part.

When the distance between the first and second surface parts is selected independently of the deflection of the armature part, the distance may be selected to be sufficiently small that capillary forces may be generated that aid in the maintaining of a dampening element, being a dampening liquid, in place.

In addition, a capillary space formed between respective surface parts may also have a shape that allows rapid and correct dosing of the desired amount of damping fluid during manufacturing of the moving armature receiver.

Alternatively, capillary structures may be provided in the first and/or second surface parts in order to define the position of a dampening liquid.

Another alternative is to use a magnetic liquid/element and magnet(s) in order to define the position of the liquid/element and to maintain the liquid in that position.

In a second aspect, the invention relates to a miniature transducer adapted to receive or generate sound. The transducer comprises a first element, a diaphragm, a motor arrangement, and a deformable damping element. The first element has a surface defining a first plane. The diaphragm extends at least substantially parallel with the first plane and is movable in relation to the first element. The first element and the diaphragm are positioned so as to overlap when projected on to the first plane. The motor arrangement is operatively coupled to the diaphragm and adapted to deflect the diaphragm so as to generate sound or to detect movement of the diaphragm so as to generate a signal related to received sound. The deformable damping element engages the surface of the first element and the diaphragm. The deformable damping element is positioned, in the projection on the first plane, in the overlap between the diaphragm and the first element.

Consequently, the deformable damping element is positioned between the diaphragm and the surface of the first element. Naturally, the damping element may also touch or be engaged by other elements or other surfaces.

The damping element being positioned between the diaphragm and the first element will provide a compression/extension of the damping element when the diaphragm moves toward/away from the first element.

In this aspect, the motor arrangement may be any type of arrangement adapted to provide energy/movement to the diaphragm or detect movement of the diaphragm. Motion generating arrangements may be those used in dynamic speakers, moving armature receivers, arrangements using piezo electric transducers or the like. Also, motion detecting arrangements may be those used in capacitive detection/microphones, electret microphones or the like. Naturally, the same set-up may be used for generating and detecting motion, even though most set-ups are primarily suited for only one of these processes.

It is clear that the first and second aspects may be combined, such as in the embodiment in which a hole/opening exists in the diaphragm.

However, according to the present aspect, also a non-broken or "normal" part of the diaphragm may be used for engaging the damping element.

Naturally, the damping element may engage or touch the diaphragm at any desired location or locations thereof depending on the amount of damping required/desired or the actual damping properties desired.

The damping may be desired to dampen a particular frequency interval or may be desired to dampen undesired swinging/deflection modes which may otherwise occur. For example, second order swinging modes, in which part of the diaphragm moves in one direction while other parts move in the opposite direction, may not be desired and may be damped.

In one embodiment, in a cross section of a plane of the diaphragm, the deformable damping element engages the diaphragm at a position thereof potentially having the largest deflection, if no damping element was used.

Naturally, the first element forming the surface may be any other element within the transducer. Thus, the first element may form a part of the second element. Alternatively, it may be part of a housing encasing the diaphragm. Also, other elements may perform this function.

In general, in both the first and second aspects of the invention, any deformable element or material may be used, such as: a gel, a cured gel, a liquid, such as a magnetic liquid, ferrofluid or oil, a fluid, a paste, and/or a foam, an emulsion, or a suspension comprising one of those.

As mentioned above, the deformable element may be magnetic in order for it to be positioned using a magnetic field.

In the present context, a deformable material may be, but need not be, compressible.

In addition, the surfaces or surface parts engaging or touching the deformable element, if it is a liquid, preferably have a contact angle with the deformable element of at least 90°. This means that the engagement with the element will deform the element and not merely have the element translate in relation to the surface. If the element was a water-based liquid, this would correspond to the surface part not being hydrophobic.

Also, when the deformable damping element is a liquid, this liquid preferably has an absolute viscosity between about 500 and about 10000 centipoise measured at room temperature, preferably between about 3000 and about 6000 centipoise. In some embodiments, the deformable damping liquid has an absolute viscosity between about 4000 and about 5000 centipoise. Liquids having this viscosity will be able to provide the desired damping of a factor of about 1.3 to about 3.5 as is desired in the most widely used miniature transducers.

In FIG. 1, an end of a moving armature receiver 10 is illustrated. This transducer normally comprises (not illustrated) a coil and a permanent magnet through which a deflectable armature 12 extends and which acts to deflect the armature 12 in correspondence with an electrical signal applied to the coil. This armature 12, as is usual, is connected to a diaphragm (not illustrated) via a drive pin 14. Thus, deflection of the armature 12 will cause deflection or movement of the diaphragm and thereby the generation of sound by the diaphragm. The deflection of the armature 12 is in the direction toward and away from the diaphragm and normally perpendicularly to a plane of the diaphragm.

In addition to these usual elements, the receiver 10 comprises a damping element 16 comprising two U-shaped elements 18 and 20, where the element 18 is attached to the drive pin 14 and the element 20 is attached to a housing or the like (such as the magnets) of the receiver 10.

The element 20 has two legs extending between the legs of the element 18. Between the legs of element 18 and the legs of element 20, a deformable damping liquid 22 is provided.

Figure 2:
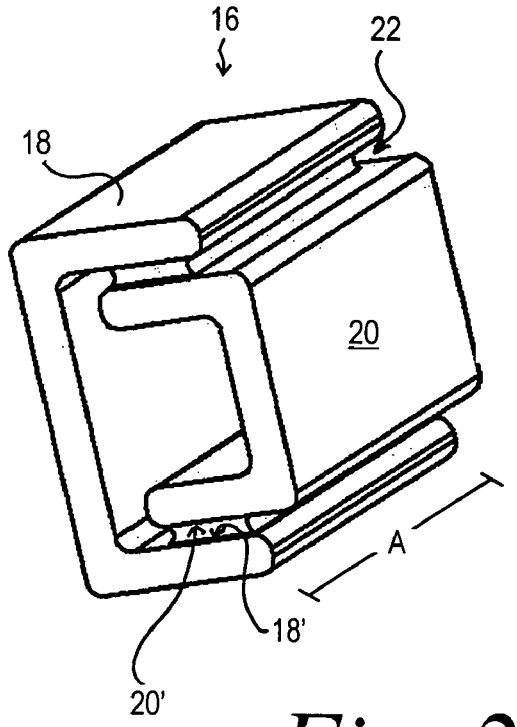
FIG. 2 is a schematic illustration of first and second cooperating damping members of a moving armature receiver according to the first embodiment of the invention.

As is best seen in FIG. 2, the surface parts (illustrated by 18' and 20') engaging the liquid 22 extend in the direction of deflection of the armature 12, so that deflection of the armature 12 will bring about a translation of one of the surfaces in relation to the other (see the arrow A in FIG. 2). This translation will bring about a deformation of the liquid 22, and the liquid 22, due to its viscosity, will act to prevent or reduce this translation/deformation. This, again, brings about a damping of this translation and thereby of the deflection of the armature 12 and of the movement of the diaphragm.

In a preferred embodiment, the outer "length" of the leg parts of the element 18 is 0.3 mm, the distance between the leg parts in the element 18 is 0.35 mm. The outer "width" of the leg parts of the element 20 is 0.3 mm, and the outer "length" of the leg parts of the element 20 is 0.2 mm. The overall length of the elements 18 and 20 in the direction of movement is 0.55 mm.

It is clear that the maximum displacement/translation possible of the surface part 18' in relation to the surface part 20' is independent of the maximum displacement possible of the armature 12 within the magnet/coil. In addition, the area of the surface parts 18' and 20' covered by the liquid 22 and the thickness of the layer of liquid 22 is independent of the displacement between the surface parts 18' and 20' as well as the maximum displacement/translation possible for the armature 12.

Naturally, the present damping element 16 may be formed in other manners. One example is one wherein the element 20 is rotated so that the bottom of the U-shape is adjacent to the bottom of the U-shape of the element 18. In this manner, the liquid 22 may contact the full inner surface of the element 18 and the outer parts of the legs and the bottom of the element 20.

Alternatively, a single surface of the elements 18 and 20 may be used for contacting the liquid 22.

It is desired, in an embodiment, to utilize the shearing forces caused by the two surface parts 18' and 20' translating and deforming the liquid 22. Thus, it is desired that the distance between the surface parts 18' and 20' is maintained during the translation.

In that situation, if the movement of the armature 12, at least at the element 20, cannot be approximated with a linear movement, it may be desired to provide the surface parts 18' and 20' with a curvature so that the movement of the surface part 20' in relation to the surface part 18' is performed without—to any substantial degree—altering the distance between the surface parts 18' and 20'.

In normal moving armature receivers, the displacement of the armature is so small that the change in distance between the surface parts 18' and 20' is very small, even if the movement, in fact, may be a rotation. If the deflection of the armature was desired to be larger, it might be desirable to adapt the surface parts 18' and 20' accordingly.

Figure 3:
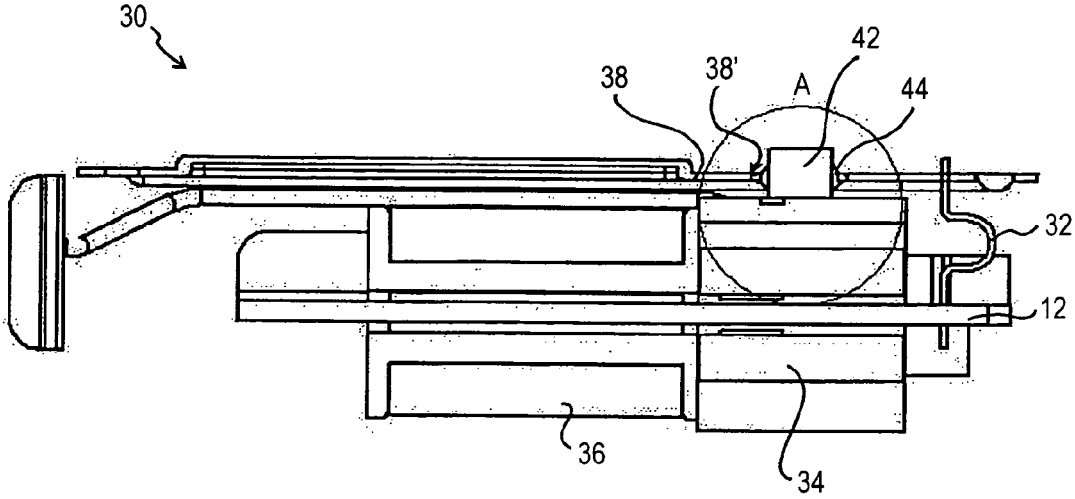
FIG. 3 is a vertical cross-sectional view of a moving armature receiver according to a second embodiment of the invention.

In FIG. 3, another preferred embodiment 30 of the present invention is illustrated in which a deflectable armature 12 drives a diaphragm 38 via a drive pin 32. The armature 12 extends through, and is driven by, a magnet assembly 34 and a coil assembly 36, as is known in the art.

The deflection or movement of the diaphragm 38 is damped by a damping assembly comprising an element 42 extending through an opening 38' in the diaphragm 38. A liquid 44 is positioned between the element 42 and the opening 38'.

The element 42 is attached to the magnet 34 and extends in the overall direction of the diaphragm 38 during its movements. The element 42 is symmetrical along an axis of that direction.

Naturally, the element 42 may be attached to or fixed to any other element in the transducer 30, such as the coil 36, a housing of the transducer, or any other element that is not able to follow the movement/deflection of the diaphragm 38.

In addition, the outer contour of the element 42, in a plane perpendicular to that direction, corresponds closely to that of the opening 38', which exists in the same plane.

The desired shearing forces, therefore, again are generated by the diaphragm 38 moving along the direction, whereby the liquid 44 is deformed and dampens the movement of the opening 38' and thereby the diaphragm 38.

Figure 4:
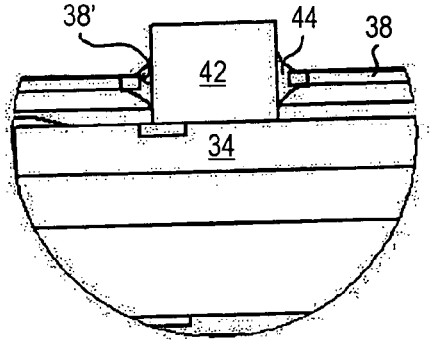
FIG. 4 is a close-up of a relevant part of FIG. 3.

FIG. 4 illustrates an enlargement of the element 42, opening 38', and the liquid 44 of FIG. 3. In this figure, it is more easily seen how the elements interact.

It is desired that the inner surface of the opening 38' is at least substantially in a direction that is perpendicular to the plane of the diaphragm 38; and thus, creating a sufficient surface with the liquid 44.

Figure 5:
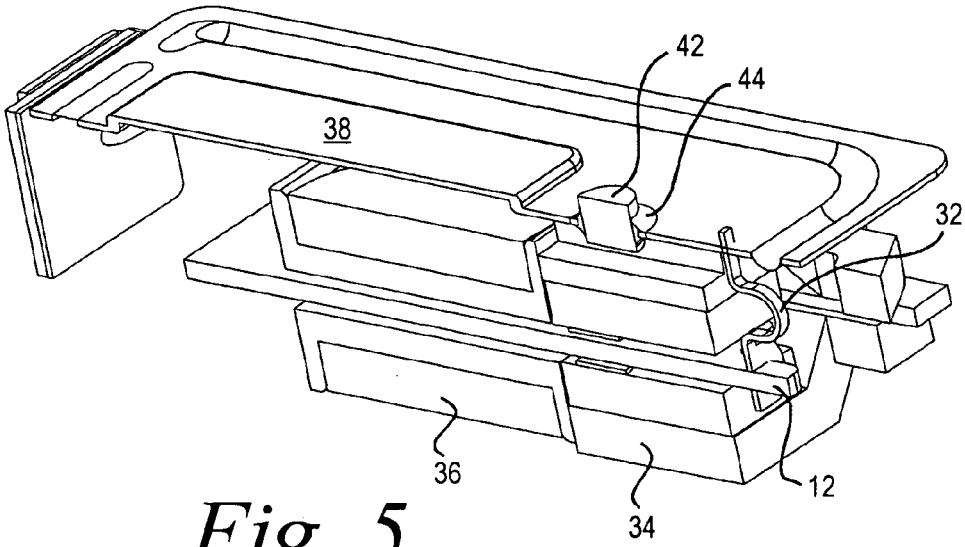
FIG. 5 is an elevated side view of the second embodiment of FIG. 3.

In FIG. 5, the transducer 30 is seen in an elevated side view. From this figure, it is seen that the element 42 and the opening 38' have circular cross sections. Naturally, any cross section will work. Also, the size of the opening 38' may be selected in accordance with production requirements and the dampening desired. Naturally, a larger opening 38' will provide a larger "disturbance" of the movement/deflection of the diaphragm 38. In addition, a larger cross section of the opening 38' may provide a larger dampening in that a larger amount of liquid 44 may be required to be deformed.

The actual position of the opening 38' in the diaphragm 38 may be selected in a number of manners. One manner is to prevent a second order vibration of the diaphragm 38, if such an order exists at or above a given frequency. In that manner, the position may be selected so as to dampen or prevent this order.

Otherwise, a position of maximum deflection (desired or non-desired deflection) of the diaphragm may be identified, and that position may be selected for the element 42 and the opening 38'.

Naturally, the position of the element 42 may also be selected depending on where, in the transducer 30, the element 42 may in fact be fixed in relation to the diaphragm 38. Normally, it would not be desirable to attach the element 42 to parts of the transducer 30, such as the armature 12, that are movable. However, in that situation, attachment of the element 42 above the diaphragm 38 (not below the diaphragm 38 as in the figures) may be possible.

Figure 6:
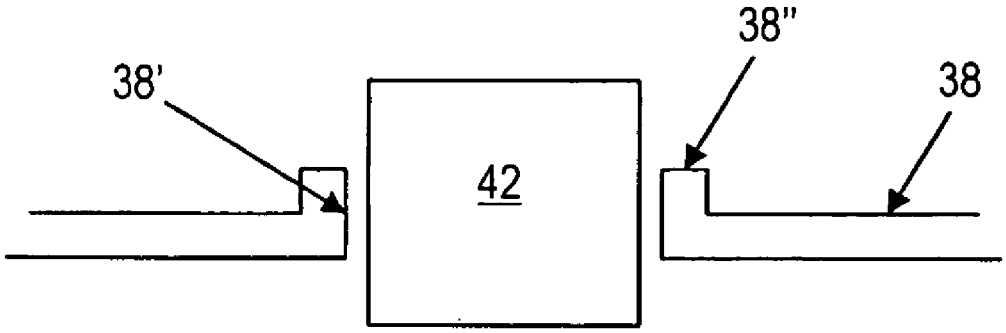
FIG. 6 is an alternative diaphragm for the second embodiment.

FIG. 6 illustrates an alternative diaphragm 38 for use in the second embodiment of FIGS. 3-5. This alternative diaphragm 38 has an upstanding part 38" that forms a surface part 38' that engages the liquid 44. The upstanding part 38" increases the surface part 38', and thereby facilitates a larger or more easily controlled damping.

Figure 7:
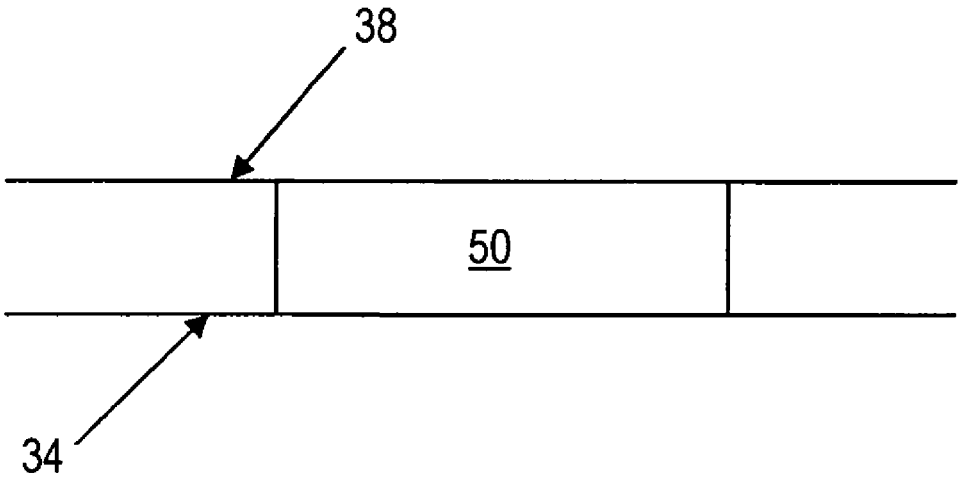
FIG. 7 is a cross section of a third embodiment of the invention.

FIG. 7 illustrates a third embodiment in which the damping of the diaphragm 38 is performed directly on the diaphragm 38. In this embodiment, the damping liquid 50 is provided between the diaphragm 38 and a surface or an element, such as the coil 34 of a moving armature receiver, parallel to the diaphragm 38.

It is clear that the embodiment illustrated in FIG. 7 is not limited to moving armature receivers but may be useful for both receivers or sound detectors, no matter the actual set-up used for generating or detecting the sound.

Providing the damping directly on the diaphragm 38 has a number of advantages, one being that the positioning of the damping may be better controlled. Another advantage is that the damping may not require the addition of any other elements than those which are normally used in the transducer.

The only requirement is the position of the other surface engaging the liquid 50. This surface preferably is parallel to the diaphragm 38 and is positioned a desired distance from the diaphragm 38 to allow the diaphragm 38 to move as desired. The desired distance should be selected so as to provide a sufficient amount of liquid 50 between the diaphragm 38 and the surface. Actually, this other surface may be a surface of a housing holding the elements of the transducer.

It is noted that the embodiment illustrated in FIG. 7 works primarily with a deformation of the liquid 50, which is a narrowing/widening of the space between the surfaces defined by the diaphragm 38 and the opposite surface presently illustrated as a surface of a coil 34 of a moving armature receiver.

While the present invention has been described with reference to one or more particular embodiments, those skilled in the art will recognize that many changes may be made thereto without departing from the spirit and scope of the present invention. Each of these embodiments and obvious variations thereof is contemplated as falling within the scope of the claimed invention, which is set forth in the following claims.

The invention claimed is:

1. A moving armature receiver comprising:

a drive coil;

a permanent magnet assembly adapted to generate a magnetic flux;

an armature comprising a deflectable armature portion being deflectable in a predetermined direction in relation to the coil and the magnet;

a diaphragm operatively attached to the deflectable armature portion;

a first and a second surface part each extending at least substantially in the predetermined direction, the first surface part forming part of or being operatively attached to the deflectable armature portion and/or the diaphragm, and the second surface part being translatable in the predetermined direction in relation to the first surface part; and a deformable damping element engaging both surface parts.

2. The receiver according to claim 1, wherein:

the drive coil forms a coil tunnel;

the permanent magnet assembly is adapted to generate the magnetic flux in a magnetic gap; and the armature extends through the coil tunnel and the magnetic gap.

3. The receiver according to claim 1, wherein a substantial part of an outer surface of the material engages the first and second surface parts.

4. The receiver according to claim 1, wherein the second surface part is at least substantially stationary in relation to the magnet and/or the coil.

5. The receiver according to claim 1, wherein the first surface part is defined by a hole or opening in the diaphragm, and wherein the second surface part is defined by an element extending though the hole or opening in the diaphragm.

6. The receiver according to claim 1, wherein the deflectable armature part is adapted to be deflected, in the predetermined direction, at least a predetermined minimum deflection, and wherein a distance between the first and second surface parts is between 10% and 1000% of the minimum deflection.

7. The receiver according to claim 1, wherein the deformable damping element is one or more of: a gel, a cured gel, a liquid, a fluid, a paste, and/or a foam, an emulsion, or a suspension comprising one of those.

8. The receiver according to claim 7, wherein the deformable damping element is a liquid having an absolute viscosity between 500 and 10000 centipoise measured at room temperature.

9. The receiver of claim 1, wherein the deformable damping element includes a first element, the first surface part being on the first element of the deformable damping element.

10. A moving armature receiver comprising:

a drive coil;

a permanent magnet assembly adapted to generate a magnetic flux;

an armature comprising a deflectable armature portion being deflectable in a predetermined direction in relation to the coil and the magnet;

a diaphragm operatively attached to the deflectable armature portion;

a first surface part extending at least substantially in the predetermined direction, the first surface part forming part of or being operatively attached to at least one of the deflectable armature portion and the diaphragm;

a second surface part extending at least substantially in the predetermined direction, the second surface part being translatable in the predetermined direction in relation to the first surface part;

a deformable damping element engaging both surface parts; and a first element comprising the first surface part and a second element comprising the second surface part, the first element being a part of or being operatively connected to the deflectable armature part or to the diaphragm, the first and second elements being U-shaped and comprising a base part and two leg parts, the leg parts of one of the first and the second elements extending between the leg parts of the other of the first and second elements, the deformable damping element being positioned between a first of the leg parts of the first and the second element.

* * * * *